US009582999B2

(12) United States Patent
Lewis

(10) Patent No.: US 9,582,999 B2
(45) Date of Patent: Feb. 28, 2017

(54) TRAFFIC VOLUME ESTIMATION

(71) Applicant: HERE Global B.V., Veldhoven (NL)

(72) Inventor: Andrew Philip Lewis, Berkeley, CA (US)

(73) Assignee: HERE Global B.V., Eindhoven (NL)

( * ) Notice: Subject to any disclaimer, the term of this patent is extended or adjusted under 35 U.S.C. 154(b) by 7 days.

(21) Appl. No.: 14/528,855

(22) Filed: Oct. 30, 2014

(65) Prior Publication Data

US 2015/0120174 A1 Apr. 30, 2015

Related U.S. Application Data

(60) Provisional application No. 61/898,142, filed on Oct. 31, 2013.

(51) Int. Cl.
*G08G 1/01* (2006.01)

(52) U.S. Cl.
CPC ..... *G08G 1/0129* (2013.01); *G08G 1/0112* (2013.01)

(58) Field of Classification Search
CPC ..... G08G 1/01–1/015; G01C 21/3415; G01C 21/3691
USPC ..... 700/117–119
See application file for complete search history.

(56) References Cited

U.S. PATENT DOCUMENTS 4,937,570 A 6/1990 Matsukawa et al.
5,379,215 A 1/1995 Kruhoeffer et al.
5,432,895 A 7/1995 Myers
5,583,972 A 12/1996 Miller
5,742,924 A 4/1998 Nakayama
5,778,332 A * 7/1998 Chang ..... G08G 1/0104 701/117
5,802,492 A 9/1998 DeLorme et al.
5,864,305 A 1/1999 Rosenquist
5,889,477 A * 3/1999 Fastenrath ..... G08G 1/0104 340/2.7
5,917,436 A 6/1999 Endo et al.
5,982,298 A 11/1999 Lappenbusch et al.
6,075,874 A * 6/2000 Higashikubo ..... G06K 9/00785 340/934
6,650,948 B1 * 11/2003 Atkinson ..... G08G 1/0104 340/995.13
6,813,555 B1 * 11/2004 Kerner ..... G08G 1/0104 701/117
8,269,653 B2 9/2012 Saunders
8,405,520 B2 3/2013 Soulchin et al.
8,626,440 B2 1/2014 Cera et al.
(Continued)

OTHER PUBLICATIONS

Fabritiis.pdf (Corrado de Fabritiis, Roberto Ragona, Gaetano Valenti, Traffic Estimation and Prediction Based on Real Time Floating Car Data, 2008, IEEE, pp. 197-203).*

*Primary Examiner* — Bao Long T Nguyen
(74) *Attorney, Agent, or Firm* — Lempia Summerfield Katz LLC

(57) ABSTRACT

Method, systems, and devices are described for determining traffic volume of one or more path segments. A computing device may receive probe data associated with a road segment from one or more sources. The computing device selects either a free flow algorithm or a congestion algorithm for the probe data, and calculates an estimated probe quantity from historical data using either the free flow algorithm or the congestion algorithm. A traffic volume may be estimated from the estimate probe quantity.

15 Claims, 9 Drawing Sheets

(56) References Cited

U.S. PATENT DOCUMENTS

| | | | | |
|---|---|---|---|---|
| 8,666,645 | B2 | 3/2014 | Saunders | |
| 8,676,480 | B2 | 3/2014 | Lynch et al. | |
| 8,781,736 | B2 | 7/2014 | Cera et al. | |
| 8,892,345 | B2 | 11/2014 | Arcot et al. | |
| 8,892,356 | B1 | 11/2014 | Weiland et al. | |
| 2002/0045985 | A1* | 4/2002 | Kerner | G08G 1/0104 701/117 |
| 2002/0193938 | A1 | 12/2002 | DeKock et al. | |
| 2004/0046759 | A1 | 3/2004 | Soulchin et al. | |
| 2005/0143902 | A1 | 6/2005 | Soulchin et al. | |
| 2007/0189181 | A1* | 8/2007 | Kirk | G01S 19/14 370/252 |
| 2007/0208494 | A1* | 9/2007 | Chapman | G08G 1/0104 701/117 |
| 2008/0071466 | A1* | 3/2008 | Downs | G08G 1/0104 701/117 |
| 2010/0228467 | A1* | 9/2010 | Wolfe | G08G 1/01 701/119 |
| 2011/0106416 | A1* | 5/2011 | Scofield | G08G 1/0104 701/119 |
| 2011/0161261 | A1* | 6/2011 | Wu | G08G 1/0104 706/12 |
| 2012/0109506 | A1* | 5/2012 | Fei | G08G 1/0116 701/118 |
| 2013/0261944 | A1* | 10/2013 | Koshizen | G08G 1/00 701/118 |
| 2014/0114885 | A1* | 4/2014 | Han | G06N 3/0454 706/12 |
| 2014/0149029 | A1* | 5/2014 | Sakakibara | G08G 1/0116 701/118 |
| 2014/0222321 | A1* | 8/2014 | Petty | G01C 21/3492 701/117 |
| 2015/0161886 | A1* | 6/2015 | Kesting | G08G 1/012 701/117 |
| 2015/0262477 | A1* | 9/2015 | Fowe | G08G 1/0133 701/118 |

* cited by examiner

TRAFFIC VOLUME ESTIMATION

RELATED APPLICATIONS

The present patent application claims the benefit of the filing date under 35 U.S.C. §119(e) of U.S. Provisional Patent Application Ser. No. 61/898,142, filed Oct. 31, 2013, which is hereby incorporated by reference herein in its entirety.

FIELD

The following disclosure relates to a traffic volume estimation based on probe data, and more particularly, to a traffic volume estimation based on probe data and an estimation of traffic density from the probe data.

BACKGROUND

Traffic reporting is the study of movement of vehicles on the roads. Analytical techniques may manage and track traffic information and derive travel times, guide driving behavior and optimize road infrastructure for cities. Traffic Message Channel (TMC) and other traffic services deliver traffic information to customers. Traffic incidents and traffic flow are reported through broadcasts. Traffic delays may be caused by one or more of congestion, construction, accidents, special events (e.g., concerts, sporting events, festivals), weather conditions (e.g., rain, snow, tornado), and so on. Traffic services typically provide a speed or a range of speeds (e.g., low, medium, high) for a particular road. Another characteristic, traffic volume measures the total throughput of traffic for a particular road over a given span of time. Traffic volume could be measured using sensors that detect every car passing a particular point on the road. The sensors could be any combination of inductive loops embedded in the roadway, radar, or cameras. These sensors can be expensive to install and maintain, and their availability varies from location to location.

SUMMARY

Method, systems, and devices are described for determining traffic volume of one or more path segments. A computing device may receive probe data associated with a road segment from one or more sources. The computing device selects either a free flow algorithm or a congestion algorithm for the probe data, and calculates an estimated probe quantity from historical data using either the free flow algorithm or the congestion algorithm. A traffic volume may be estimated from the estimate probe quantity.

BRIEF DESCRIPTION OF THE DRAWINGS

Exemplary embodiments of the present invention are described herein with reference to the following drawings.

DETAILED DESCRIPTION

Traffic estimation, modeling, prediction, and management have traditionally depended on measurement of both traffic speeds and traffic volumes. The increasing ubiquity of personal mobile devices, such as dedicated global positioning system (GPS) units, cell phones, or other navigation devices, provides another source of data, probe points. Probe points provide information about speed and heading for a vehicle. Samples for the speed of the vehicle may be reported in a configurable time interval (e.g., 1 second, 10 seconds, 1 minute, or another value). Currently, the percentage of vehicles about which data is collected (e.g., penetration rate) may be on the order of 0.1% to 5%. This amount of data is generally sufficient to generate reliable estimates of current traffic speed, especially on highways, and when real-time data is missing at a particular location, historical data may be used to fill in the gaps.

In contrast, the low penetration rate and uneven sampling rate may disrupt attempts to determine traffic volumes directly from probe data. But by combining real-time and historical data about probe volumes, traffic volumes may be estimated using probe volumes as a proxy. In congested conditions, this provides real-time estimates of traffic volume. In one example, traffic volumes are estimated in free-flow conditions based on weekly patterns.

Figure 1:
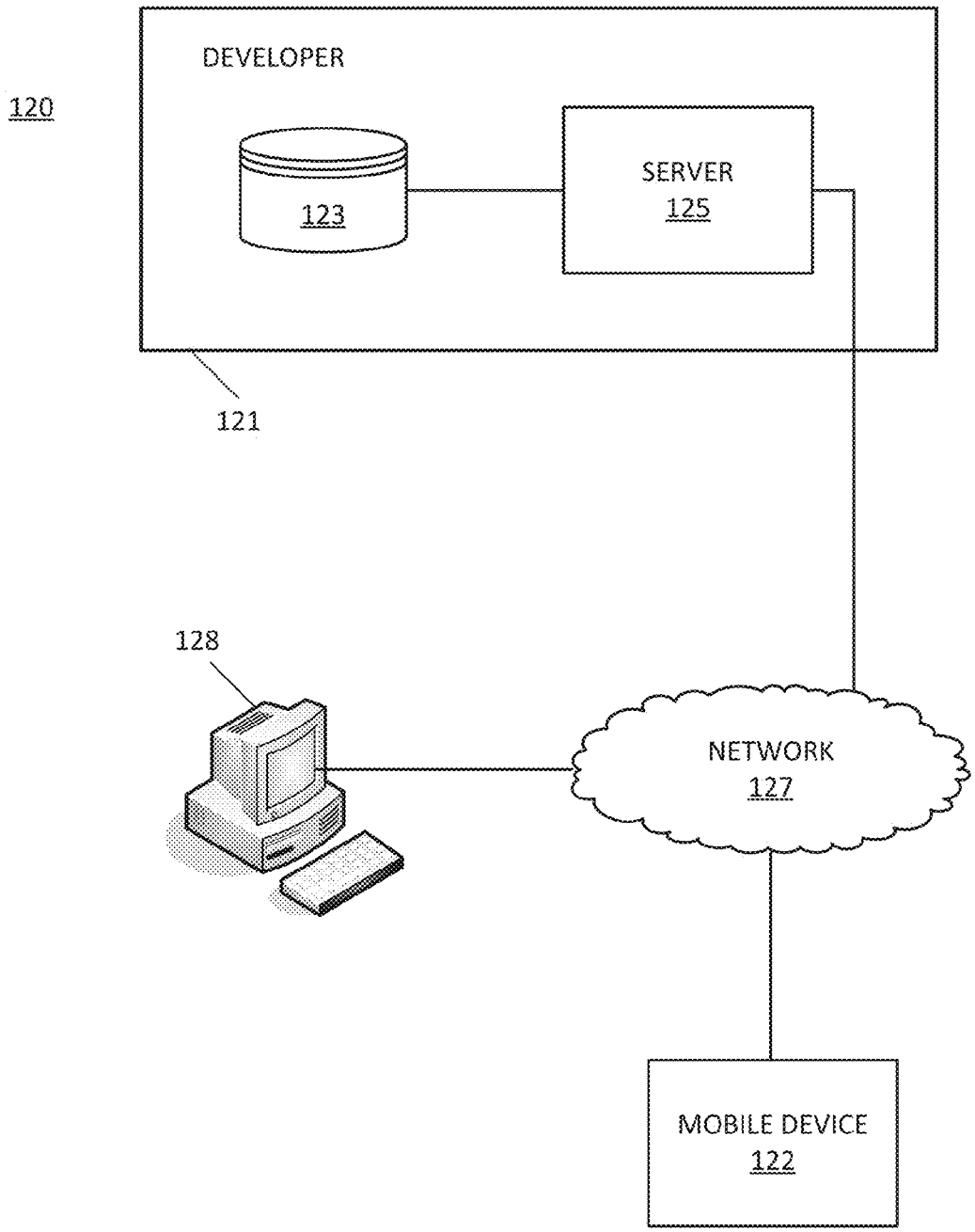
FIG. 1 illustrates an example system for traffic volume estimation.

FIG. 1 illustrates an exemplary traffic volume estimation system 120. The system 120 includes a developer system 121, a mobile device 122, a workstation 128, and a network 127. Additional, different, or fewer components may be provided. For example, many mobile devices 122 and/or workstations 128 may connect with the network 127. The developer system 121 includes a server 125 and a database 123. The developer system 121 may include computer systems and networks of a navigation system operator. The mobile device 122, or multiple mobile devices, collects the probe data and the server 125 performs the following algorithms.

Traffic on a given stretch of road can be characterized by a density (ρ) in (vehicles/unit distance), traffic flow (q) in (vehicles/unit time), and velocity (v) in (distance/unit time). The distance may be miles, kilometers, meters or another length unit. The time may be hours, minutes, seconds or another time unit. Traffic flow, density, and velocity are related according to equation 1.

$$q=\rho v \qquad \text{Eq. 1}$$

The triangular fundamental diagram demonstrates that below a certain critical density 21 in FIG. 2, traffic is in free-flow, and flow increases linearly with density. Above the critical density 21, traffic is congested, and flow decreases (again roughly linearly) as density increases. The critical density 21 may be constant or vary as a function of the specific road, the functional classification of the road, the weather, the time of day, or another factor. The slope of the free flow segment 23 is the free flow velocity ($V_f$) or related to the free flow velocity. The slope of the congestion segment 25 is the congestion speed parameter ($V_c$), which describes the speed at which the location of the back edge of a congested segment propagates upstream (in the opposite direction from the direction of travel), and is typically between 10 kilometers per hour and 25 kilometers per hour.

Figure 3:
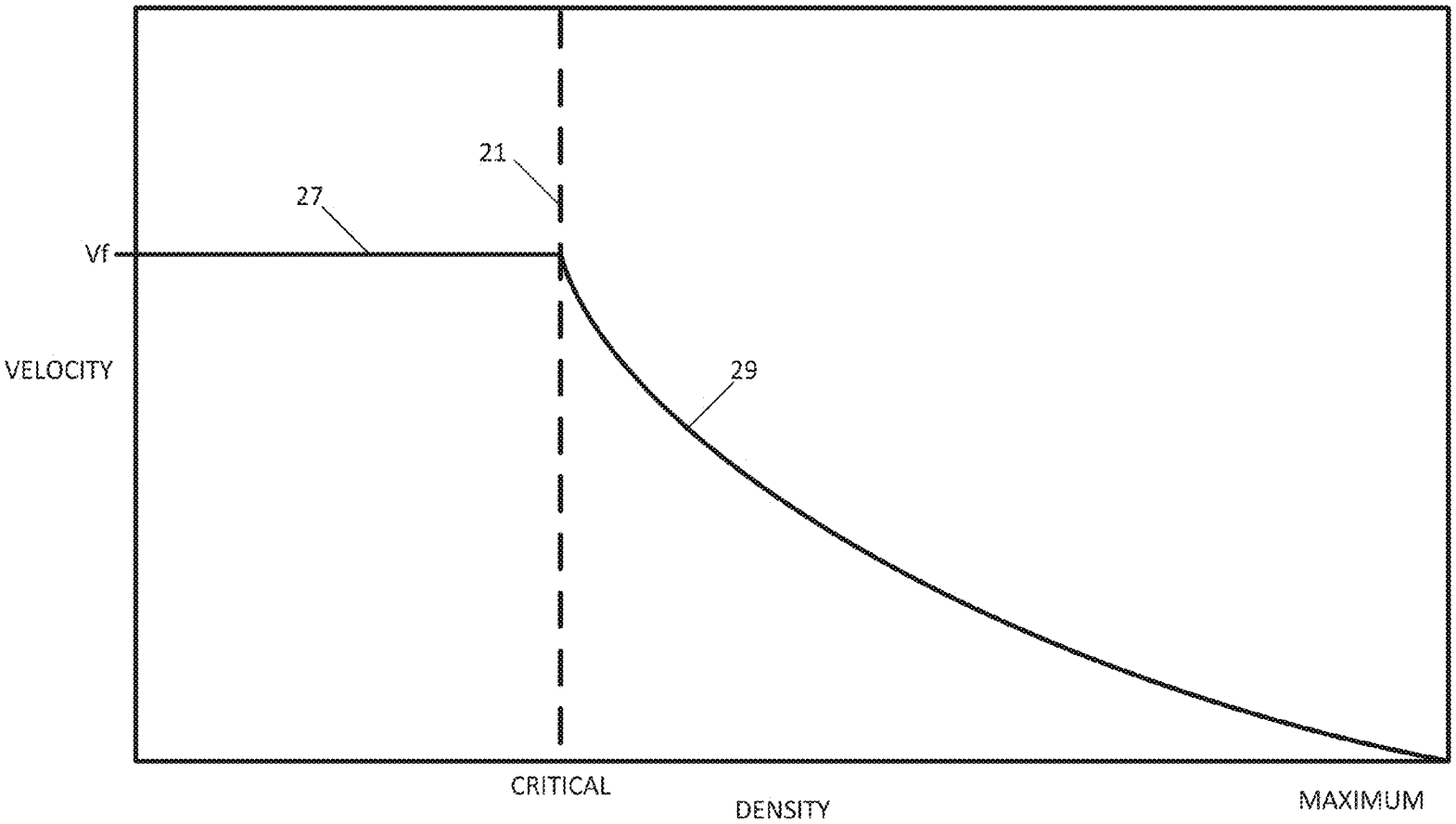
FIG. 3 illustrates an example relationship between traffic velocity and traffic density.

Using the above Equation 1 for flow, density and velocity, and the triangular fundamental diagram in terms of the equivalent relationship between density and velocity, a diagram for velocity may be derived, as shown in FIG. 3.

The diagram for velocity may include two or more piecewise functions. The left-hand portion function 27 is a horizontal line segment that indicates that velocity is constant, at the free flow velocity $V_f$, until density reaches the critical density 21. The right-hand portion 29 is a non-linear function. The right-hand portion 29 may be logarithmic, exponential, elliptical, or hyperbolic function. When the density versys flow fundamental diagram is triangular, the right hand-portion 29 of the diagram for velocity is hyperbolic. The right-hand portion may have a high slope near the critical density and a lower slope as density increases. The right-hand portion 29 of the diagram for velocity demonstrates that when traffic is congested there is a fixed relation between traffic velocity and density on a given segment of road. This relationship may be limited to congested conditions. A congestion condition may be defined based on speed or flow. The congestion condition may be defined as densities greater than the point at which the flow is a maximum. The maximum of the flow may be derived from probe data, sensor data, or a combination. Alternatively, the congestion condition may be a predetermined percentage (e.g., 50%, 70%, or 80%) of the speed limit. In free-flow conditions velocity is roughly constant, so any relation between velocity and density may have less of a correlation.

Figure 4:
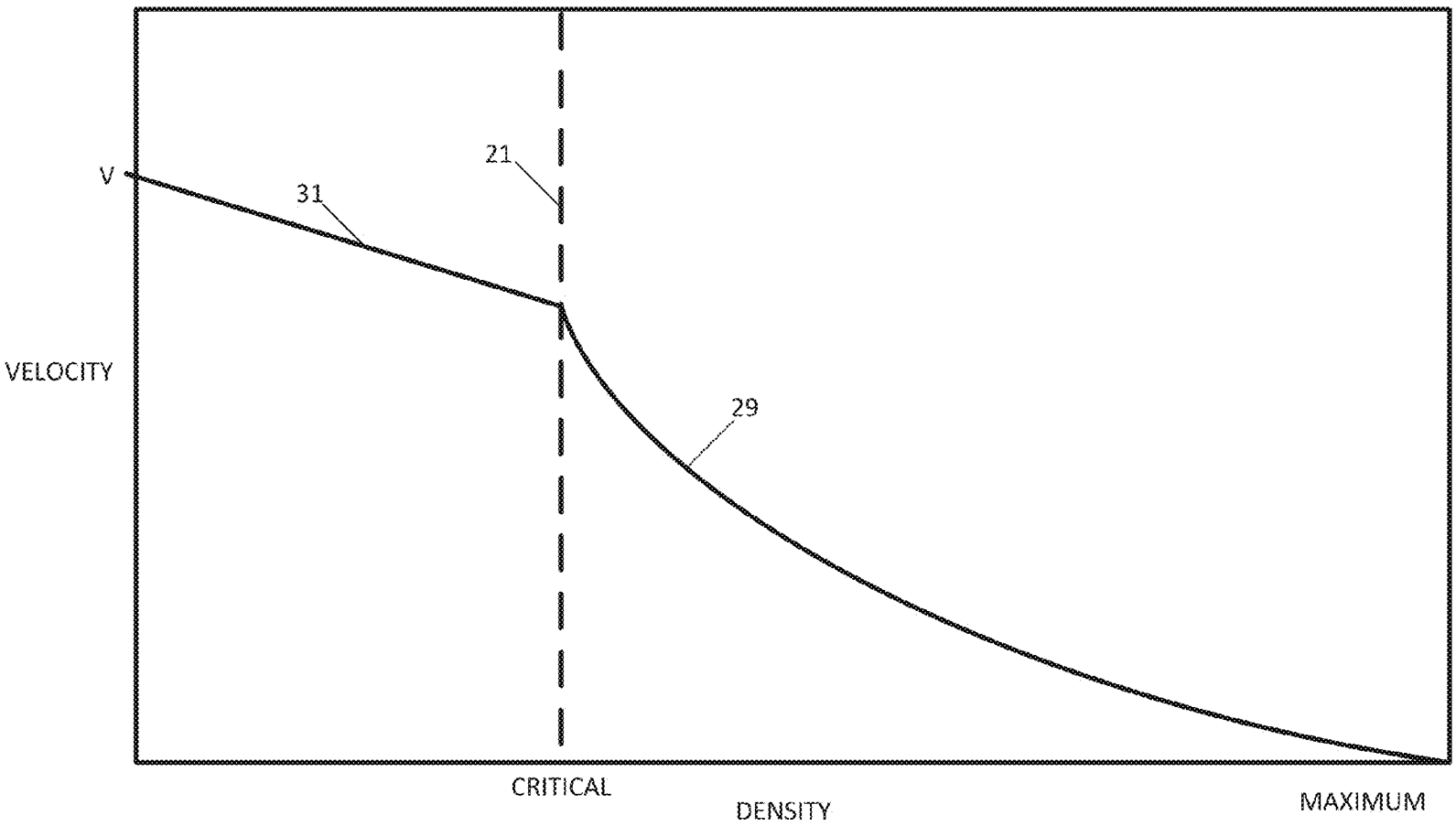
FIG. 4 illustrates an example relationship between traffic velocity and traffic density.

FIG. 4 illustrates another example for the relationship between velocity and density. The left-hand portion 31 representing the velocity for density less than the critical density 21 is variable. The velocity in this region may be linear but not constant. In one example, the velocity decreases with a slight negative slope until the critical density 21. The right-hand portion may be similar to that described above with respect to FIG. 3 such as a hyperbolic function. In this example, the relationship between velocity and density is invertible.

Equation 2 demonstrates that when the density is less than the critical density, flow is equal to a constant velocity $v_0$ (e.g., the speed limit or a free flow speed) multiplied by density, and when the density exceeds the critical density, flow is equal to a linearly decreasing function of density having a slope equal to a jam propagation speed (w). The constant K is chosen to make the function q continuous at the critical density.

$$q = \begin{cases} v_0\rho, & \rho < \rho_c \\ K - w\rho, & \rho > \rho_c \end{cases} \quad \text{Eq. 2}$$

Equivalently, by combining Equation 1 and Equation 2, Equation 3 demonstrates a function for velocity. Velocity is constant at $v_0$ when the density is less than the critical density. Velocity is a hyperbolic function of constant K, density, and the jam propagation speed when density is greater than the critical density.

$$v = \begin{cases} v_0, & \rho < \rho_c \\ \frac{K}{\rho} - w, & \rho > \rho_c \end{cases} \quad \text{Eq. 3}$$

Sensors such as inductive loops may be configured to measure flow, occupancy (the proportion of time that a vehicle is above the sensor) and velocity directly. An inductive loop may include one or more windings of electrically conductive material (e.g., wire) buried within or mounted adjacent to a roadway. A current flowing through the conductive material creates a magnetic field. As vehicles pass through or near the magnetic field, the magnetic field is altered. A counting device electrically connected to the inductive loop counts the number of disruptions in the magnetic field, which is also the number of vehicles that travel the road, and occupancy. Occupancy is related to density by the average length of a vehicle passing over the sensor. Density is estimated using an estimate of this average vehicle length, which can vary based on time and type of road. Some loop sensors consist of two loops, and the delay in sensing a vehicle between the two loops gives a direct estimate of velocity. For those loop sensors consisting of only a single loop, velocity is estimated from the flow count and the density estimate, using Eq. 1.

Probe points are direct measurements of velocity of the probe (e.g., mobile device) coming from a single vehicle. The probe point may be generated based on reported positions of the mobile device 122 or multiple mobile devices. The mobile device 122 may report location data from which the server 125 determines the speed of the mobile device 122. Alternatively, the mobile device 122 may calculate speed and report speed directly to the server 125.

Figure 2:
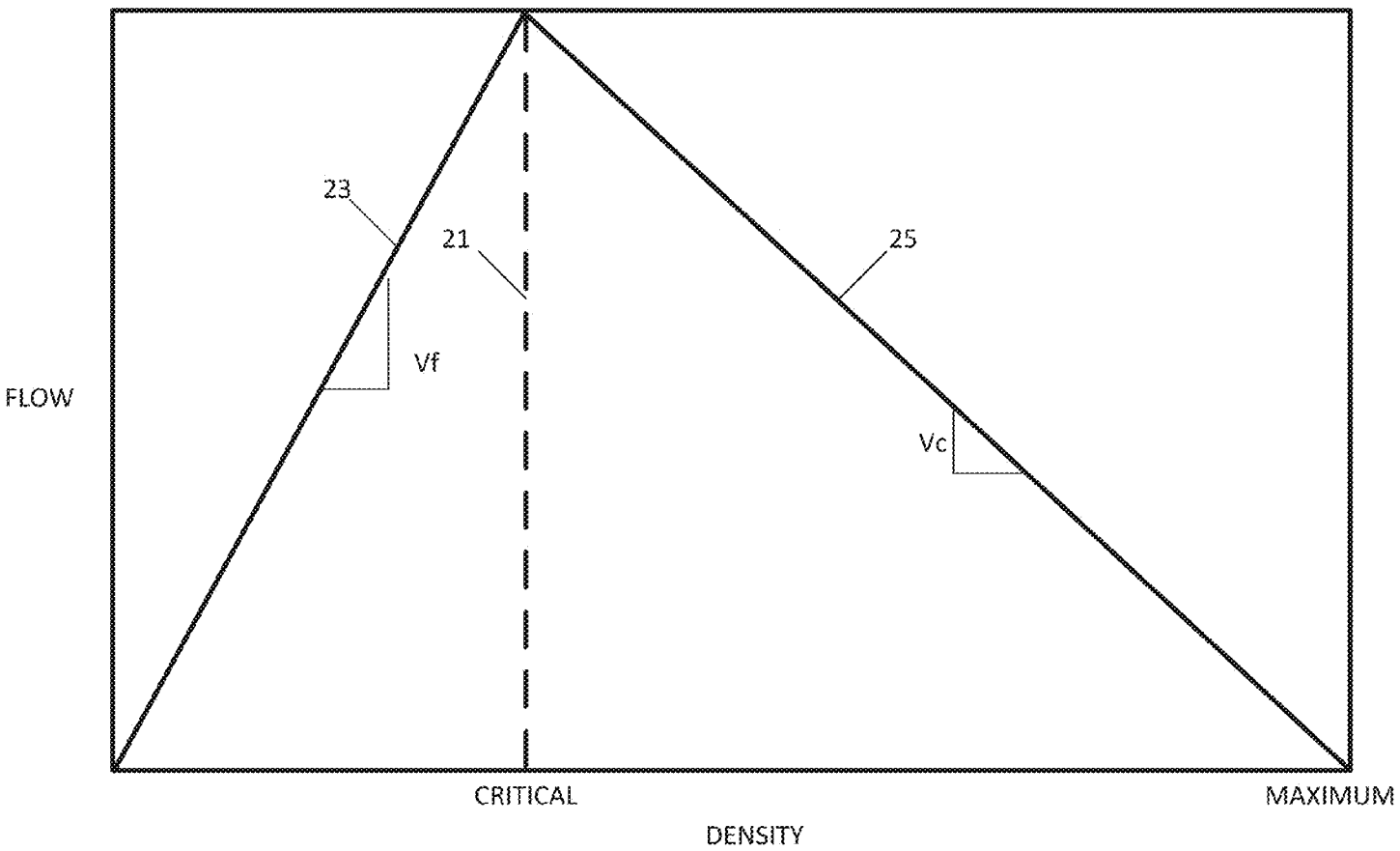
FIG. 2 illustrates an example relationship between traffic flow and traffic density.

It has been found empirically that a given stretch of road traffic tends to show a fixed relationship between density and flow, known as the triangular fundamental diagram as shown in FIG. 2.

On average, the number of individual probe points (E) observed on a given segment of road over a fixed period of time is proportional to the average traffic density on that segment of road, as shown by Equation 4. In other words, Equation 4 provides a number of unique probe points, which is substantially proportional to and estimates traffic volume.

$$E = \rho \cdot L \cdot \Delta t \cdot R \quad \text{Eq. 4}$$

E(# probe points)=the expected number of probe points observed, ρ=Density (vehicles/mile), L=length of road segment (miles), Δt=duration of epoch (hours), and R=average probe rate (probes/vehicle/hour). Thus, for any density determined from on a lookup table based on FIGS. 2 and 3, the characteristics of the road (length), time, and characteristics of the penetration (average probe rate), provide an estimated total number of probe points according to Equation 4. Conversely, knowing E (the average number of probe points associated with given traffic conditions, e.g. speed and time of day), along with the length, time, and average probe rate, allows an estimation of ρ, the vehicle density associated with those traffic conditions.

Equation 4 is independent of velocity. The variance in the number of probe points observed in a small period of time is very large, so a real-time count of probe points does not give a good estimate of traffic density. But by averaging together many time periods with similar traffic conditions, the average probe count for those periods estimate density.

In free-flow conditions, the velocity is not closely correlated with the traffic density. But traffic volumes tend to be repeatable from week to week. So roughly the same volume of traffic on a given segment of road at the same time of day and day of the week may be expected. Such a relationship allows volumes in free-flow conditions to be estimated using probes, using Equation 4 and Equation 1.

Traffic density for a given segment of road based on probes may be estimated piecewise, using one algorithm for congested conditions and another algorithm for free-flow conditions.

The algorithm for congested traffic examines time intervals (e.g., epochs) in a predetermined time duration (e.g., a year). All time intervals may be used or the time intervals may be filtered based on a predetermined factor (e.g., time, weather, events, traffic on other roads). The time intervals are grouped by velocity. The velocity assigned to each time interval may be an average velocity of the probes for the time interval or may be based on some other algorithm used to estimate velocity from discrete measurements, such as a Kalman filter. When no probe data is available for a given time interval, the velocity estimate may be based on historical data.

Bins may be created to group the velocity estimate by velocity intervals (e.g., 0-10 m.p.h., 10-20 m.p.h., 20-30 m.p.h., 30-40 m.p.h., 40-50 m.p.h., and so on). The intervals may be the same size or different sizes. The sizes of the intervals may be based on the distribution of the velocity data. In each bin, the number of probes for all of the epochs in the bin is counted. The average number of probe points per epoch (or the total number of probe points) observed for each of the velocity intervals across all of the time epochs is calculated.

The algorithm for free-flow traffic uses historical data for individual time of day and days of the week from the historical data in which traffic was in free flow. For example, the historical traffic data for which velocity was at the free flow velocity is organized by epoch (e.g., all Tuesdays at 2:00 p.m. with free-flow traffic are grouped together). The average number of probe points for each group of free-flow epochs is calculated.

The number of probe points from either algorithm is used to estimate the traffic volume using the percentage or vehicles on the road segment that are sending probe data. The relationship may be derived by geographic area or by time frame. The relationship may be associated with individual road segments. In one example, a stretch of road nearby with a loop detector, which detects precise traffic volume, is used to derive the relationship between the number of probe points and the total traffic volume.

In one example, for new observations, a single probe point or multiple probe points may be collected to give a real-time estimate of current traffic velocity. From the velocity and time, either the algorithm for free-flow traffic or the algorithm for congestion traffic is selected. From either algorithm, the average number of probe points for this road segment at this time and traffic conditions is estimated. Using Equation 4, the traffic density p in each case is equal to those average probe counts divided by the length L of the road segment, the duration $\Delta t$ of the time epoch, and the average probe rate per vehicle R. Accordingly, the volume or flow q for the road segment may also be estimated using according to Equation 1.

In one example, probe points are weighted depending on the sources when building the model for free-flow traffic, the model for congested traffic, or both. When counting probes, proves from source A may be associated with a first weight and probes from source B may be associated with a second weight The weights may be assigned based on confidence (e.g., a fleet of trucks may produce more reliable data than mobile phones) or quantity of the probes. When source A is assigned a weight of 1 and source B is assigned a weight of 0.2, and for a given epoch of the historical data there are two data points from source A and three probes from source B, a score or probe count for the epoch may be 2.6. The score or probe count is a measure of the confidence of the data used to generate the free-flow traffic model or the congested traffic model. The calculations may be repeated for multiple or all time epochs.

Testing of this algorithm has been performed on highways in the San Francisco bay area, and compared to ground truth measurements of flow obtained from inductive loop detectors maintained by the Department of Transportation. The tests using only probe gave statistically reliable results compared to the loop measurements, in both free-flow and congested conditions.

Volumes estimated using these algorithms have several applications in traffic measurement and management. Operations performance measurement involves the identification of road segments with recurring congestion problems and estimations of the number of vehicles affected by the congestion and the cost in vehicle-hours of the delays. Volume heat maps and understanding of utilization of existing capacity may be generated using this information about road capacities and traffic volume patterns can be used to estimate the effects of changes in either the road network itself or its usage patterns. For example, in those areas suffering from recurring congestion estimates about how much additional capacity would be needed to alleviate the congestion, or what the effects of other changes (e.g. congestion pricing) might be.

In addition, the effects (both on volumes and speeds) of potential changes in demand, due, for example, to new construction, population growth, changes in employment patterns, and other factors may be estimated. These algorithms may also be applied to traffic management for arterials, possibly in conjunction with separate work measuring driver behavior around on-ramps and off-ramps. A better understanding of long-term volume on arterials could be used, for example, to improve signal timing algorithms.

The mobile device 122 may be any type of computing device, including a personal computer. The mobile device may be a smart phone, a mobile phone, a personal digital assistant ("PDA"), a tablet computer, a notebook computer, a personal navigation device ("PND"), a portable navigation device, a built-in vehicle navigation system, and/or any other known or later developed portable or mobile computing device.

The optional workstation 128 is a general purpose computer including programming specialized for the following embodiments. For example, the workstation 128 may receive user inputs for defining the time intervals, the relationship between probe quantity and traffic volume, or other values. The workstation 128 includes at least a memory, a processor, and a communication interface.

The developer system 121, the workstation 128, and the mobile device 122 are coupled with the network 127. The phrase "coupled with" is defined to mean directly connected to or indirectly connected through one or more intermediate components. Such intermediate components may include hardware and/or software-based components.

Figure 5:
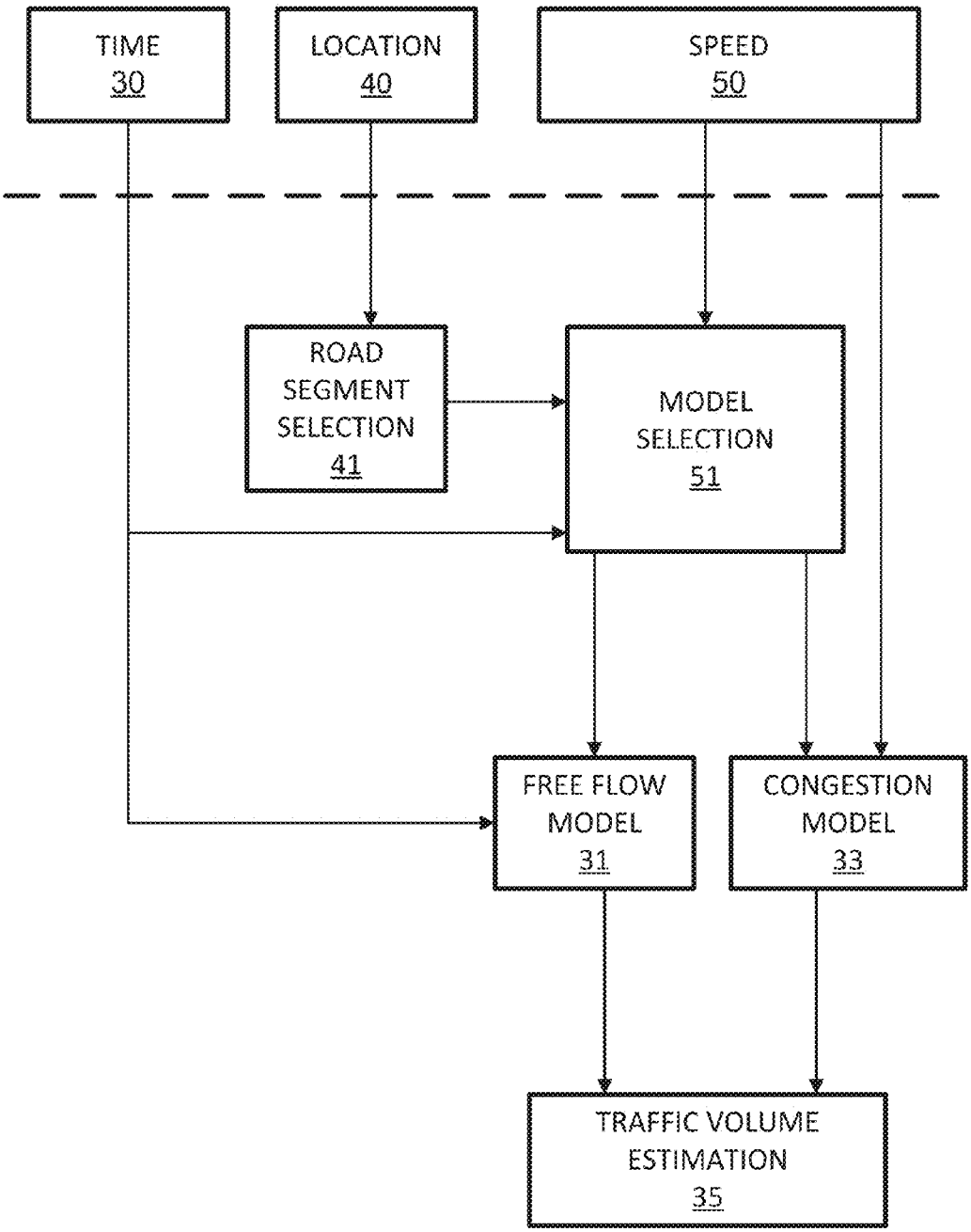
FIG. 5 illustrates an example block diagram for traffic volume estimation.

FIG. 5 illustrates an example block diagram for traffic volume estimation. Inputs to the block diagram, above the dotted line, include time data 30, location data 40, and speed data 50. One or a combination of the time data 30, location data 40, and speed data 50 may be referred to as the probe data. The time data 30 may include a time stamp associated with a time that the location data 40 and/or the speed data 50 are collected. The time data 30 may include any combination of a time of day, day of the week, or day of the year. The location data 40 may include geographic coordinates. The speed data 50 may be derived from a series of points in the location data 40. In another example, the speed data 50 may be received from a speed sensor (e.g., speedometer).

From the location data 40 a geographic database (e.g., database 123) may be queried to determine a road segment 41. The geographic database may store locations of opposing nodes for the road segment 41. The closest road segment to the geographic coordinates may be selected. In another example, the coordinates should be within a predetermined distance (e.g., 1 meter, 10 feet) to the road segment. An algorithm called a map-matcher may match the road segments to the location data.

A model selection 51 is determined as a function of the speed data 50, the time data 30, and the location data 40. The speed data 50 may be compared to a threshold value to determine whether a free flow model 31 or a congestion model 33 should be used. As an example, when the speed data 50 is less than the threshold value, the congestion model 33 may be used. When the speed data 50 is more than the threshold value, the free flow model 31 may be used.

The threshold value for the model selection 51 may be chosen based on time data 30. For example, the speed values that signify congestion may depend on the time of day or day of week. In the early morning hours (e.g., 1-3 A.M.), slow speeds may not be good indicators of congestion because congestion is so unlikely. Time may be divided into time epochs.

Example sizes for time epochs include 15 minutes, 30 minutes, 1 hour, or another value. In the example of 15 minute epochs, the traffic data is formatted into 96-dimensional vectors, in which each of the 96 components describe traffic for a different 15 minute epoch. For example, a daily traffic vector having 96 components may be defined as $\vec{x}=(x_1, \ldots, x_n)$, where n=96. The values contained in the vector may be speeds for a given epoch. For example, the first element of the vector is the average speed for time between 0:00 a.m. to 0:15 a.m., and the 50th element of the vector is the average speed for time between 12:15 p.m. and 12:30 p.m. Other vectors may be used. In another example, some days may have only two time epochs: rush hour and not rush hour. Table 1 includes example road segments having one, two, or three different time epochs.

TABLE 1

| Road Segment | Time Epoch | Threshold Values for Speed |
|---|---|---|
| X1 | Early morning, 0:00 to 6:00 | $V_{1A}$ |
| X1 | Remaining Times | $V_{1B}$ |
| Y2 | Early morning, 0:00 to 6:00 | $V_{2A}$ |
| Y2 | Rush hours, 6:01-8:30 and 16:01-18:30 | $V_{2B}$ |
| Y2 | Remaining Times | $V_{2C}$ |
| Z3 | All times | $V_3$ |

The threshold value for the model selection 51 may be chosen based on functional classification of the road segment. For example, interstate highways may be considered congested at higher speeds than state highways or local roads. Table 2 lists example classification systems that may be assigned numeric values for functional class. The functional class of the road segment may be described as a numerical value (e.g., 1, 2, 3, 4, and 5) represented in the feature vector. Functional class 1 may be highways while functional class 5 may be small streets. Table 2 further illustrates schemes having three to six functional classes. The various functional classifications may have different threshold speed values for determination congestion versus free flow. The threshold speed values may generally go from high speeds to low speeds as Table 2 moves from the top to the bottom. The threshold value for the model selection 51 may be chosen based on both time epoch and functional classification of the road segment.

TABLE 2

| Simple System | Complex System | U.S. Long Distance Roads | Highway Tags |
|---|---|---|---|
| Arterial Road | Interstates | Interstate Expressway | Motorway |
| Collector Road | Principal Arteries | Federal Highway | Trunk |
| Local Road | Minor Arteries | State Highway | Primary |
| | Major Collector | County Highway | Secondary |
| | Minor Collector | Local Road | Tertiary |
| | Local Road | | Residential |

One example of a simple system includes the functional classification maintained by the United States Federal Highway administration. The simple system includes arterial roads, collector roads, and local roads. The functional classifications of roads balance between accessibility and speed. An arterial road has low accessibility but is the fastest mode of travel between two points. Arterial roads are typically used for long distance travel. Collector roads connect arterial roads to local roads. Collector roads are more accessible and slower than arterial roads. Local roads are accessible to individual homes and business. Local roads are the most accessible and slowest type of road. In one example, the arterial road has a high threshold value (e.g., 50 mph), the collector road has a medium threshold value (e.g., 30 mph), and the local road has a small threshold value (e.g., 10 mph).

An example of a complex functional classification system is the urban classification system. Interstates include high speed and controlled access roads that span long distances. The arterial roads are divided into principle arteries and minor arteries according to size. The collector roads are divided into major collectors and minor collectors according to size. Another example functional classification system divides long distance roads by type of road or the entity in control of the highway. The functional classification system includes interstate expressways, federal highways, state highways, local highways, and local access roads. Another functional classification system uses the highway tag system in the Open Street Map (OSM) system. The functional classification includes motorways, trunk roads, primary roads, secondary roads, tertiary roads, and residential roads.

Using either the free flow model 31 or the congestion model 33, a traffic volume estimation 35 is made. The traffic volume estimation 35 may be a probe quantity or an indication of the total number of vehicles traveling on the selected road segment. When the free flow model 31 is used, the traffic volume estimation 35 may be made primarily based on time epoch (e.g., time data 30). The free flow model 31 may include a lookup table that associates possible traffic volumes according to time epoch and road segment. In one example, the lookup table outputs traffic volume directly, and in another example, the lookup table outputs traffic density, and traffic volume is calculated according to one of the relationships above. The lookup table (e.g., free flow lookup table) may be generated from historical data collected on each road segment and averaged within individual time epochs.

TABLE 3

| Free-flow Lookup Table | | | |
|---|---|---|---|
| Road Segment | Time Epoch | Traffic Density | Traffic Volume |
| X1 | Early morning, 0:00 to 6:00 | $\rho_{1A}$ | $Q_{1A}$ |
| X1 | Remaining Times | $\rho_{1B}$ | $Q_{1B}$ |
| Y2 | Early morning, 0:00 to 6:00 | $\rho_{2A}$ | $Q_{2A}$ |
| Y2 | Rush hours, 6:01-8:30 and 4:01-6:30 | $\rho_{2B}$ | $Q_{2B}$ |
| Y2 | Remaining Times | $\rho_{2C}$ | $Q_{2C}$ |
| Z3 | All times | $P_{3A}$ | $Q_{3A}$ |

When the congestion model 33 is used, the traffic volume estimation 35 may be made primarily based on the speed data 50. The congestion model 33 may include a lookup table (e.g., congestion model lookup table) that associates possible traffic volume according to speed or velocity. In one example, the lookup table outputs traffic volume directly, and in another example, the lookup table outputs traffic density, and traffic volume is calculated according to one of the relationships above. The traffic volume may be independent of time epoch. That is, the congestion model lookup table may be based on the average traffic volume for specific speeds or speed ranges at any time.

TABLE 4

| Congestion Lookup Table | | | |
|---|---|---|---|
| Road Segment | Speed or Speed Range | Traffic Density | Traffic Volume |
| X1 | $V_1$ | $\rho_{1A}$ | $Q_{1A}$ |
| X1 | $V_2$ | $\rho_{1B}$ | $Q_{1B}$ |
| X1 | $V_3$ | $P_{1C}$ | $Q_{1C}$ |
| Y2 | $V_1$ | $\rho_{2A}$ | $Q_{2A}$ |
| Y2 | $V_2$ | $\rho_{2B}$ | $Q_{2B}$ |
| Y2 | $V_3$ | $\rho_{2C}$ | $Q_{2C}$ |

In one example, the congestion model lookup table may span multiple road segments. That is, the congestion model lookup table may be based on the average traffic volume for speed ranges on a set of multiple road segments for speed ranges at any time. The set of multiple road segments may be road segments for a single road. For example, the set of multiple road segments may be a series or sequence of road segments making up a highway. The set of multiple road segments may be the road segments in a geographic region (e.g., town, city, or other region).

In one example, after the congestion model 33 is used the model selection 51 may revert back to the free flow model 31. For example, in some scenarios, the model selection 51 overrules a determination that the road segment is under congestion. For example, even when the current speed of the road segment is less that the threshold velocity, the model selection 51 determines that a current time period for the road segment is very unlikely to experience congestion. Such congestion blackout times may occur in the early hours of the morning, during holidays, or during certain events. For example, road segments in a geographic region or along a highway may be deemed not to ever experience congestion during 1 A.M. to 4 A.M. Other road segments (e.g., in downtown areas) may experience congestion during this time. Some road segments may be deemed to not ever experience congestion during major holidays.

The traffic volume estimation 35 may calculate the estimate traffic volume as a weighted average among multiple sources. The sources may include one or more types of mobile devices. The mobile devices may be fleet tracking devices carried by a fleet of vehicles. The mobile devices may be a set of mobile phones running a particular mobile application. The mobile application may be a map application that provides navigation or mapping features to a user. The mobile application may also report location data with or without knowledge of the user. The mobile application may provide an incentive to the user to permit sharing of location data. The incentive may be a compensatory incentive (e.g., money, coupon, or application store credits).

The one or more sources may be prioritized to impact the traffic volume estimation 35 differently. For example, a first coefficient may be assigned to the probe data from a first source, and a second coefficient may be assigned to the probe data from the second source. The estimated probe quantity may be calculated as a function of the first coefficient and the second coefficient or the traffic volume is estimated from the first coefficient and the second coefficient. The coefficients may be a fractional or decimal value between 0 and 1.

The coefficients may be assigned as a function of the sampling rate of the respective probe data. For example, mobile device may report probe data multiple times on the same road segments, and different types of mobile devices may have different sampling rates. In one example, the probe data includes a device identifier indicative of the manufacturer of the mobile device, the operating of the mobile device, or the mobile application that collects probe data. The coefficient for the probe data may be assigned as a function of one or more components of the device identifier.

In one example, fleet tracking devices are weighted with a high coefficient and other mobile devices are weighted with a low coefficient.

Figure 6:
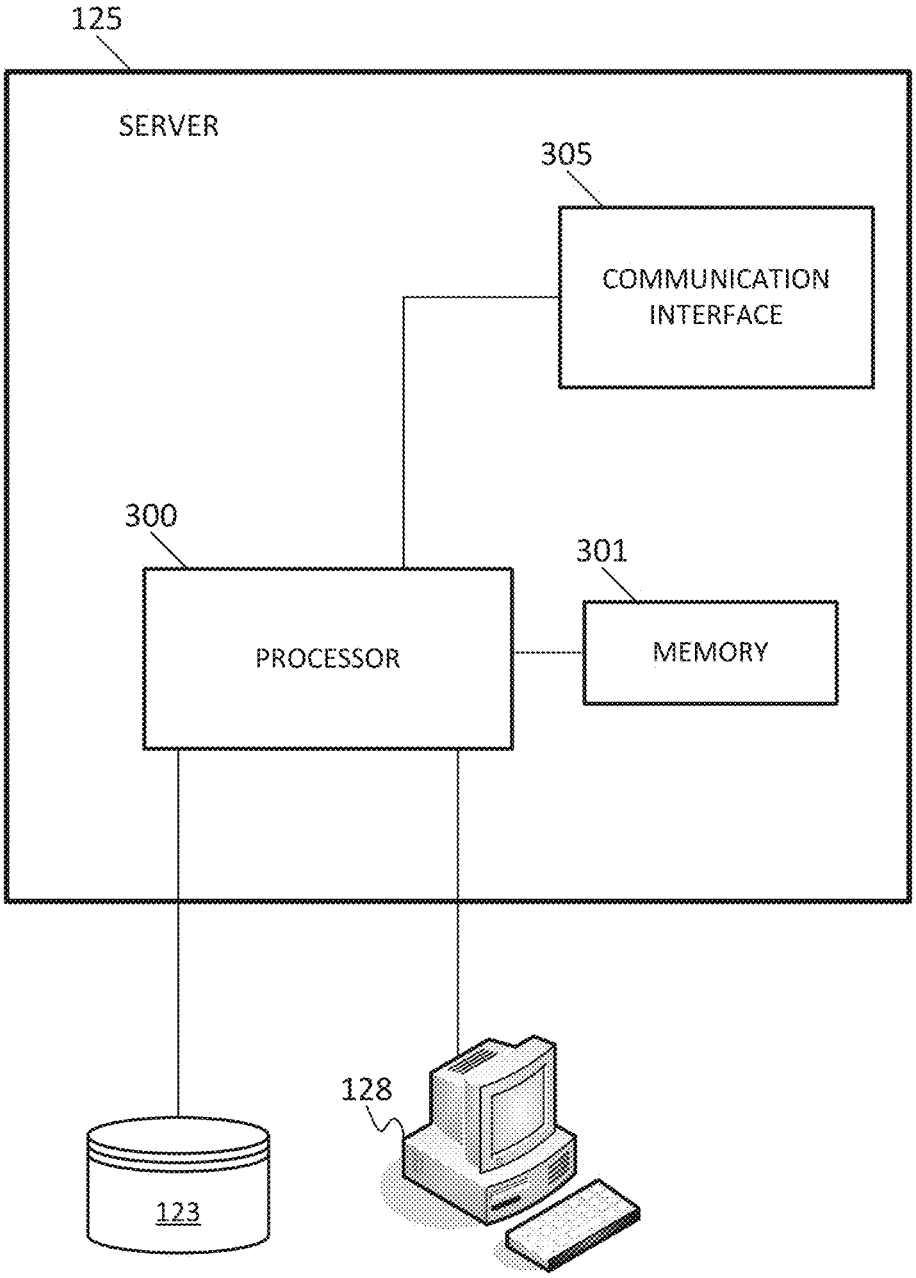
FIG. 6 illustrates an exemplary server of the system of FIG. 1.

FIG. 6 illustrates an exemplary server 125 of the system of FIG. 1. The server 125 includes a processor 300, a communication interface 305, and a memory 301. Additional, fewer, or different components may be used. The memory includes computer program code for one or more programs and the processor 300 is configured to cause the server 125 to perform the programs. The server 125 may be coupled to a database 123 and a workstation 128. The workstation 128 may be used as an input device for the server 125. In addition, the communication interface 305 is an input device for the server 125. The communication interface 305 receives data indicative of user inputs made via the workstation 128 or the mobile device 122.

Figure 7:
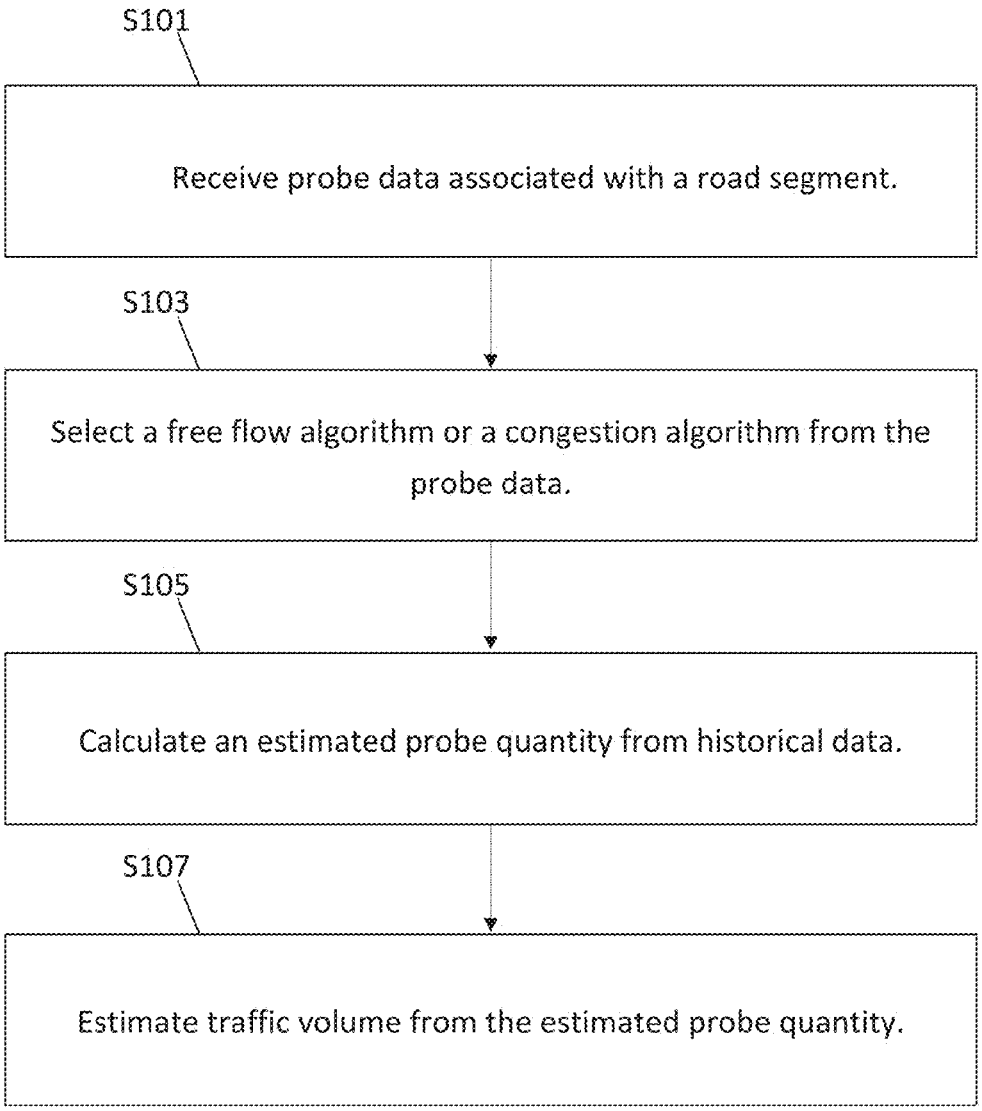
FIG. 7 illustrates an example flowchart for traffic volume estimation.

FIG. 7 illustrates an example flowchart for estimating traffic volume. Additional, different, or fewer acts may be provided. At act S101, the communication interface 304 receives probe data associated with a road segment. The probe data may include a velocity value. The road segments may be indexed by geographical location (e.g., longitude and latitude). The current road segment may be selected based on GPS data also received from the mobile device 122.

At act S103, the processor 300 selects a free flow algorithm or a congestion algorithm from the probe data. The processor 300 may compare the velocity value from the probe data to a congestion threshold in order to select the algorithm. The congestion threshold may be received from a user or predetermined. The congestion threshold may be variable as a function of time of day, time of year, weather, or another factor. The congestion threshold may be a function of the road segment (e.g., different road segments may have different congestion thresholds).

At act S105, the processor 300 calculates an estimated probe quantity from historical data using either the free flow algorithm or the congestion algorithm. The free flow algorithm may estimate probe quantity based on an average of the number of probes over an extended period of time (e.g., a year) for the particular epoch. The free flow algorithm includes a free flow lookup table that associates a time epoch derived from the probe data to a traffic density.

The congestion algorithm may estimate probe quantity independent of the epoch and based on the velocity in other epochs over the extended period of time. The congestion algorithm includes a congestion lookup table that associate a velocity derived from the probe data to a traffic density. In one example, another comparison is made. The congestion algorithm may identify a time epoch from the probe data, access a threshold velocity based on the time epoch, and compare the threshold velocity to the velocity derived from the probe data. When the velocity from the probe data exceeds the threshold velocity, the congestion algorithm may revert to the free flow algorithm.

At act S107, the processor 300 estimates traffic volume from the estimated probe quantity. The relationship between probe quantity and traffic volume may be empirical. Measurements may be taken along a stretch of road using sensors. The sensor data is compared to the probe data for the stretch of road to derive the relationship. For a road, a type of road, or a geographical area the relationship between probe quantity and traffic volume may be substantially consistent or constant.

Figure 8:
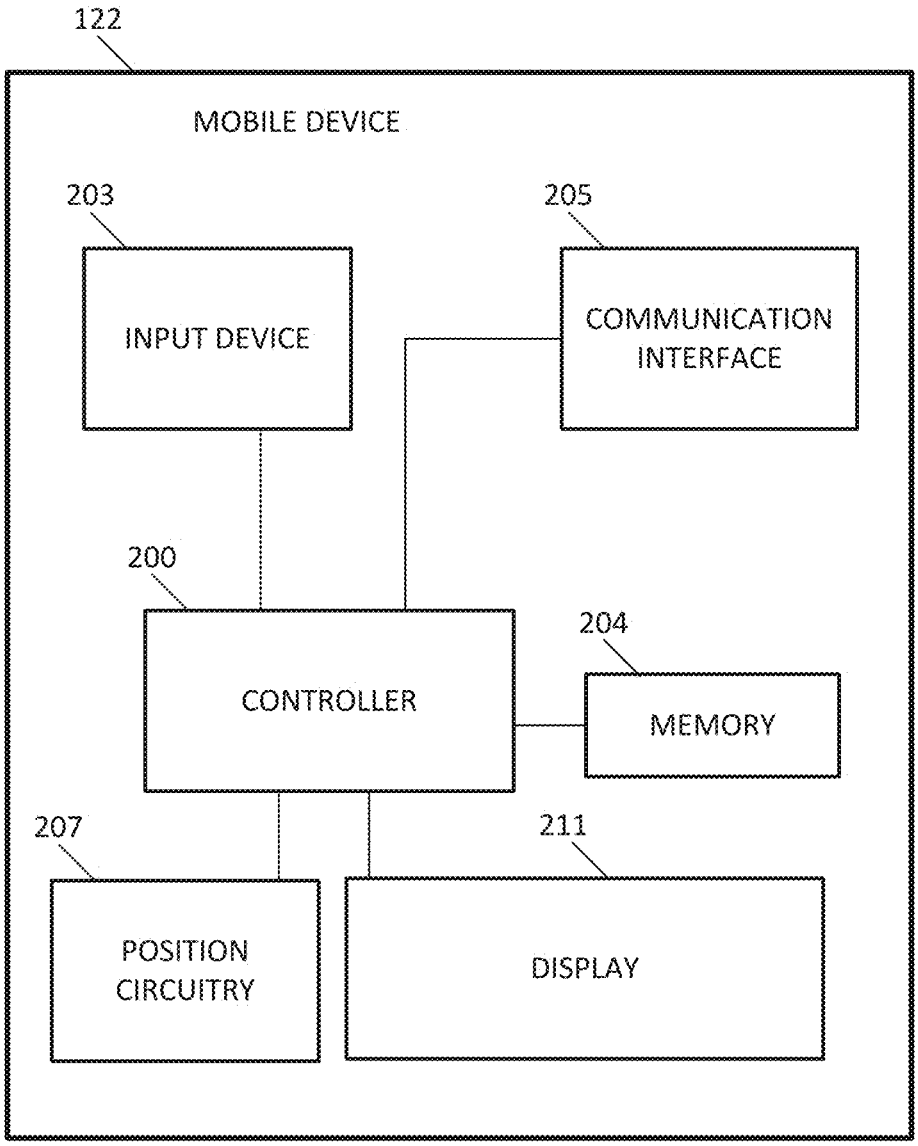
FIG. 8 illustrates an exemplary mobile device of the system of FIG. 1.
Figure 9:
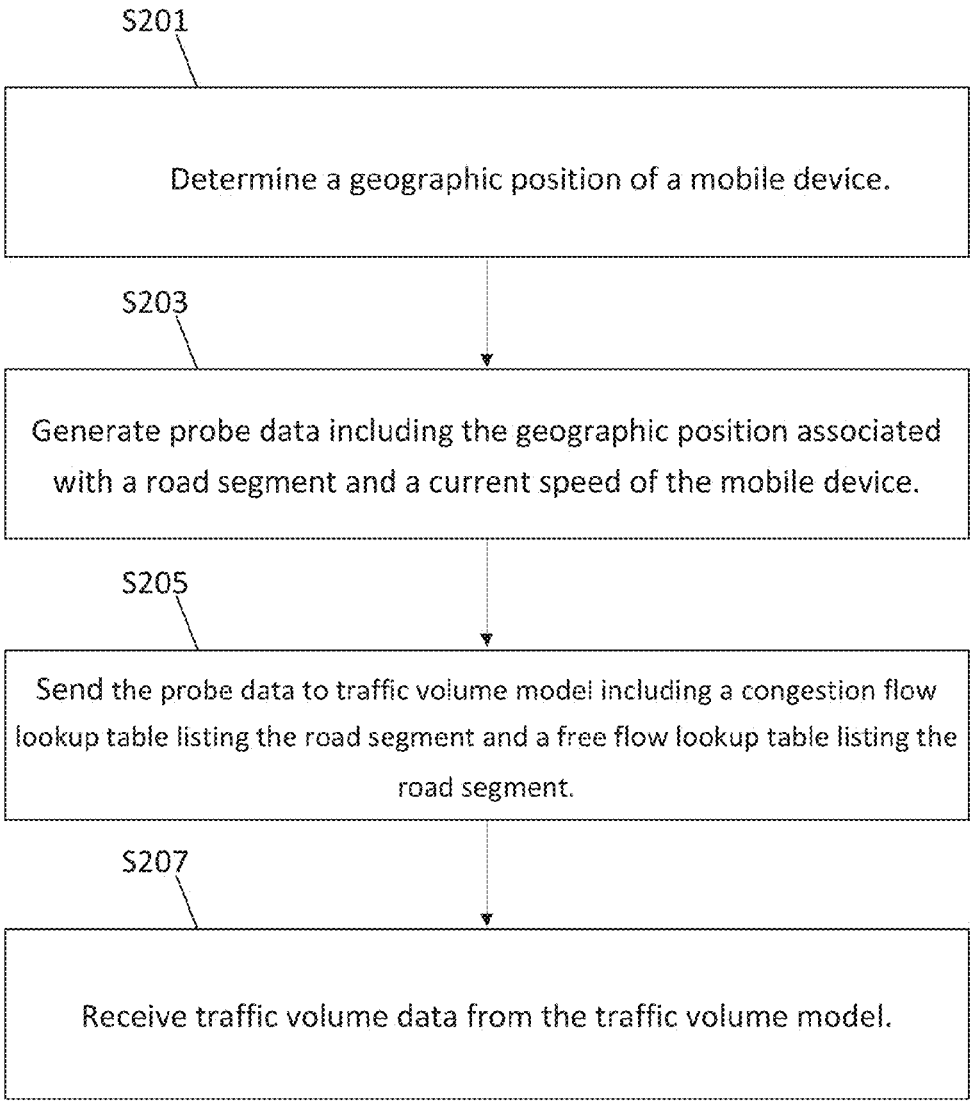
FIG. 9 illustrates an example flowchart for traffic volume estimation.

FIG. 8 illustrates an exemplary mobile device 122 of the system of FIG. 1. The mobile device 122 may be referred to as a navigation device. The mobile device 122 includes a controller 200, a memory 204, an input device 203, a communication interface 205, position circuitry 207, a camera 209, and a display 211. Additional, different, or fewer components may be included.

At act S201, the position circuitry 207 or the controller 200 is configured to determine a geographic position of the mobile device 122. At act S203, the controller 200 generates probe data including the geographic position associated with a road segment and a current speed of the mobile device 122.

At act S205, the controller 200 sends the probe data to traffic volume model including a congestion flow lookup table listing the road segment and a free flow lookup table listing the road segment. The traffic volume model may be stored at memory 204 and executed by the controller 200. In another example, the traffic model volume may be executed at the server 125.

At act S207, the controller 200 receives traffic volume data from the traffic volume model. The controller 200 may be configured to predict a future traffic state of a subsequent road segment based on the traffic volume data for the road segment. The controller 200 may calculate predictive traffic levels for downstream road segments based on the traffic volume data. For example, a predicted traffic level 15 minutes or an hour into the future for a particular road segment may be calculated based on current traffic volumes of the road segments that feed into the road segment. This may be particularly useful on a highway with a lane closure. The segment may not be experiencing traffic delays now, and upstream segments having no lane closures may not be experiencing traffic delays now. However, as traffic volume increases in the upstream segments, the controller 200 may determine that the downstream segment with the closure will likely experience traffic delays. The controller 200 may generate a message for display 211 to instruct the driver to choose an alternative route or otherwise warn the driver regarding the upcoming traffic congestion that may soon form.

Governments may also utilize the traffic volume data. When potential traffic congestion can be recognized ahead of time, measures may be taken to mitigate the traffic congestion. The allocation of express lanes or high occupancy lanes may be adjusted to relieve traffic pressure in one direction when the other direction would normally be assigned to express lanes at that time. On ramps may be closed or restriction using traffic lights or metering. A moving road block may be dispatched to regulate the flow and prevent stop and go traffic. Pricing of toll roads may be changed to match demand.

Other application for the traffic volume data may be useful over time. Traffic volume data that measures the number of vehicles passing a point may be used to calculate the cost of billboards or other advertising or optimal locations for billboards or other advertising. The traffic volume data may be used to identify roads in need of widening or other construction. The traffic volume data may be used to monitor wear and tear of road surfaces or paint to determine when replacement is needed without initially inspecting the road.

The position circuitry 207 is configured to collect probe data. Subsequent position measurements may be used to calculate the velocity of the mobile device 122. Velocity may be measured over several location data points. The position circuitry 207 also generates location data for the mobile device 122.

The input device 203 may include one or more buttons, keypad, keyboard, mouse, stylist pen, trackball, rocker switch, touch pad, voice recognition circuit, or other device or component for inputting data. The input device 203 may be combined with a display as a touch screen, which may be capacitive or resistive. The display may be a liquid crystal display (LCD) panel, light emitting diode (LED) screen, thin film transistor screen, or another type of display.

The processor 300 and/or the controller 200 may include a general processor, digital signal processor, an application specific integrated circuit (ASIC), field programmable gate array (FPGA), analog circuit, digital circuit, combinations thereof, or other now known or later developed processor. The processor 300 and/or the controller 200 may be a single device or combinations of devices, such as associated with a network, distributed processing, or cloud computing.

The memory 301 and/or the memory 204 may be a volatile memory or a non-volatile memory. The memory 301 may include one or more of a read only memory (ROM), random access memory (RAM), a flash memory, an electronic erasable program read only memory (EEPROM), or other type of memory. The memory 204 may be removable from the mobile device 122, such as a secure digital (SD) memory card.

The communication interface 305 and/or the communication interface 205 may include any operable connection. An operable connection may be one in which signals, physical communications, and/or logical communications may be sent and/or received. An operable connection may include a physical interface, an electrical interface, and/or a data interface. The communication interface 305 and/or the communication interface 205 provides for wireless and/or wired communications in any now known or later developed format.

The network 127 may include wired networks, wireless networks, or combinations thereof. The wireless network may be a cellular telephone network, an 802.11, 802.16, 802.20, or WiMax network. Further, the network 127 may be a public network, such as the Internet, a private network, such as an intranet, or combinations thereof, and may utilize a variety of networking protocols now available or later developed including, but not limited to TCP/IP based networking protocols.

While the non-transitory computer-readable medium (e.g., memory 301, memory 204) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

I claim:

1. A method comprising:

receiving probe data from one or more mobile devices and generated by position circuitry, the probe data associated with a road segment;

selecting between a free flow algorithm and a congestion algorithm based on one or more values from the probe data generated by the position circuitry;

calculating an estimated probe quantity from historical data using either the free flow algorithm or the congestion algorithm;

querying a free flow lookup table with a time epoch from the probe data, when the free flow algorithm is selected;

receiving a traffic density from the free flow lookup table, when the free flow algorithm is selected; and estimating traffic volume from the traffic density.

2. The method of claim 1, further comprising:

generating the free flow algorithm and the congestion algorithm based on historical density levels for the road segment according to time epoch.

3. The method of claim 2, wherein the historical density levels are calculated from probe data received from one or more sources.

4. The method of claim 3, wherein receiving probe data comprises:

receiving probe data from a first source from one or more mobile devices; and receiving probe data from a second source from one or more mobile devices.

5. The method of claim 4, the method further comprising:

assigning a first coefficient to the probe data from the first source; and assigning a second coefficient to the probe data from the second source, wherein the estimated probe quantity is calculated as a function of the first coefficient and the second coefficient, or wherein the traffic volume is estimated from the first coefficient and the second coefficient.

6. A method comprising:

receiving probe data from one or more mobile devices and generated by position circuitry, the probe data associated with a road segment;

selecting between a free flow algorithm and a congestion algorithm based on one or more values from the probe data generated by the position circuitry;

calculating an estimated probe quantity from historical data using either the free flow algorithm or the congestion algorithm;

when the congestion algorithm is selected, identifying a velocity derived from the probe data;

when the congestion algorithm is selected, identifying a time epoch from the probe data;

accessing a threshold velocity based on the time epoch;

comparing the threshold velocity to the velocity derived from the probe data; and estimating traffic volume from the comparison of the threshold velocity to the velocity derived from the probe data.

7. The method of claim 6, further comprising:

when the velocity from the probe data exceeds the threshold velocity, reverting to the free flow algorithm.

8. The method of claim 7, further comprising:

when the velocity from the probe data is less than the threshold velocity, accessing a congestion density lookup table.

9. An apparatus comprising:

at least one processor; and at least one memory including computer program code for one or more programs;

the at least one memory and the computer program code configured to, with the at least one processor, cause the apparatus to at least:

receive probe data from one or more position sensors, the probe data associated with a road segment;

select a free flow algorithm when one or more values from the probe data are at a first level and a congestion algorithm when one or more values from the probe data are at a second level;

calculate an estimated probe quantity from historical data using either the free flow algorithm or the congestion algorithm; and calculate traffic volume for the road segment from the estimated probe quantity, wherein the free flow algorithm includes a free flow lookup table that associates a time epoch derived from the probe data to a traffic density, or wherein the congestion algorithm includes a congestion lookup table that associate a velocity derived from the probe data to a traffic density.

10. The apparatus of claim 9, wherein the congestion algorithm includes instructions to:

identify a time epoch from the probe data;

access a threshold velocity based on the time epoch; and compare the threshold velocity to the velocity derived from the probe data.

11. The apparatus of claim 10 wherein when the velocity from the probe data exceeds the threshold velocity, the congestion algorithm reverts to the free flow algorithm.

12. The apparatus of claim 9, wherein the one or more position sensors include a first sensor from one or more mobile devices and a second sensor from one or more mobile devices.

13. The apparatus of claim 12, the at least one memory and the computer program code configured to, with the at least one processor, cause the apparatus to at least:

assign a first coefficient to the probe data from the first sensor; and assign a second coefficient to the probe data from the second sensor, wherein the estimated probe quantity is calculated as a function of the first coefficient and the second coefficient, or wherein the traffic volume is estimated from the first coefficient and the second coefficient.

14. A method comprising:

receiving first probe data for a road segment from a first mobile device source of a first vehicle;

receiving second probe data for the road segment from a second mobile device source of a second vehicle;

assigning a first coefficient to the first probe data from the first mobile device source;

assigning a second coefficient to the second probe data from the second mobile device source;

selecting a free flow algorithm or a congestion algorithm based on one or more values from the first probe data and the second probe data;

calculating an estimated probe quantity from historical data using either the free flow algorithm or the congestion algorithm, wherein the estimated probe quantity is calculated as a function of the first coefficient and the second coefficient;

calculating an estimated traffic volume from the estimated probe quantity, and when the free flow algorithm is selected:

querying a free flow lookup table with a time epoch from the first probe data or the second probe data; and receiving a traffic density from the free flow lookup table.

15. A method comprising:

receiving first probe data for a road segment from a first mobile device source of a first vehicle;

receiving second probe data for the road segment from a second mobile device source of a second vehicle;

assigning a first coefficient to the first probe data from the first mobile device source;

assigning a second coefficient to the second probe data from the second mobile device source;

selecting a free flow algorithm or a congestion algorithm based on one or more values from the first probe data and the second probe data;

calculating an estimated probe quantity from historical data using either the free flow algorithm or the congestion algorithm, wherein the estimated probe quantity is calculated as a function of the first coefficient and the second coefficient;

calculating an estimated traffic volume from the estimated probe quantity, and when the congestion algorithm is selected:

identifying a velocity derived from the first probe data or the second probe data;

identifying a time epoch from the first probe data or the second probe data;

accessing a threshold velocity based on the time epoch; and comparing the threshold velocity to the velocity derived from the first probe data or the second probe data.

* * * * *